US006105282A

United States Patent [19]

Wiand

[11] Patent Number: 6,105,282

[45] Date of Patent: Aug. 22, 2000

[54] ABRASIVE-FILLED POLYMER GOLF SHOE SPIKE

[76] Inventor: Ronald C. Wiand, 2379 Belmont Ct., Troy, Mich. 48098

[21] Appl. No.: 09/116,729

[22] Filed: Jul. 16, 1998

Related U.S. Application Data

[60] Provisional application No. 60/052,640, Jul. 16, 1997.

[51] Int. Cl.[7] ..... A43B 5/00; A43B 15/00

[52] U.S. Cl. ..... 36/134; 36/67 R; 36/67 D; 36/59 R

[58] Field of Search ..... 36/67 R, 67 A, 36/134, 67 D, 59 R

[56] References Cited

U.S. PATENT DOCUMENTS

| | | | |
|---|---|---|---|
| 3,573,155 | 3/1971 | Mitchell | 36/59 R |
| 3,768,183 | 10/1973 | Fessenden | 36/67 R |
| 3,802,951 | 4/1974 | Mitchell | 36/59 R |
| 4,160,331 | 7/1979 | Bell | 36/59 B |
| 4,779,360 | 10/1988 | Bible | 36/59 R |
| 5,367,793 | 11/1994 | Deacon | 36/59 R |
| 5,732,484 | 3/1998 | Grutza et al. | 36/134 |

FOREIGN PATENT DOCUMENTS

| | | | |
|---|---|---|---|
| 3233900 | 3/1984 | Germany | 36/67 R |
| 2098457 | 11/1982 | United Kingdom | 36/134 |

*Primary Examiner*—M. D. Patterson
*Attorney, Agent, or Firm*—Harness, Dickey & Pierce, P.L.C.

[57] ABSTRACT

A spike for a golf shoe is provided which has a base portion adapted for attachment to the golf shoe for providing traction on turf. This spike is injection molded with a mixture of a polymer material and an abrasive grit material. As such, this material improves the resistance of the spike to wear and abrasion.

3 Claims, 1 Drawing Sheet

ABRASIVE-FILLED POLYMER GOLF SHOE SPIKE

This appln claims benefit of provisional appln No. 60/062,640 filed Jul. 16, 1997.

BACKGROUND OF THE INVENTION

The present invention relates to a spike for use on a golf shoe. More particularly, the present invention relates to a so-called "soft" spike which is useful as a replacement of metal spikes commonly used on golf shoes, but which has greater abrasion resistance, increasing the longevity of a such a spike.

In recent years, many golf clubs have urged or required the use of polymer replacement spikes for the metal spikes which have commonly been used in the years past on golf shoes. One reason for this, is that steel spikes tend to do significant damage to the putting surfaces of greens and flooring surfaces in golf club houses and, therefore, it is desired to remove this damaging propensity from golf shoe footwear.

In recent years, various non-damaging spikes have been made from polymer materials. Many of these spikes have different configurations than typical golf spikes, and typically are made of soft, resilient, polymer materials. While these new types of golf spikes have reduced some of the damage to the putting greens and wear on floor surfaces in golf clubs or the like, they have had the disadvantage of wearing much more quickly than standard metal golf spikes.

Thus, there is a need in the art to provide an improved golf spike of the non-damaging nature, which has improved wear characteristics.

SUMMARY OF THE INVENTION

In accordance with the present invention, there is provided a spike for a golf shoe. The spike for a golf shoe includes a base portion which is adapted for attachment to a golf shoe, and a turf-gripping spike portion which provides traction on the turf. The improvement of the present invention is that the spike portion which grips the turf is injection molded with a mixture of a polymer plastic material and an abrasive grit material. The abrasive grit material provides improved abrasion resistance to wear and abrasion, and increases the life of the golf spike.

Additional objects, advantages and features of the present invention will become apparent from the following description and appended claims, taken in conjunction with the accompanying drawings. All citations are hereby incorporated by reference.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
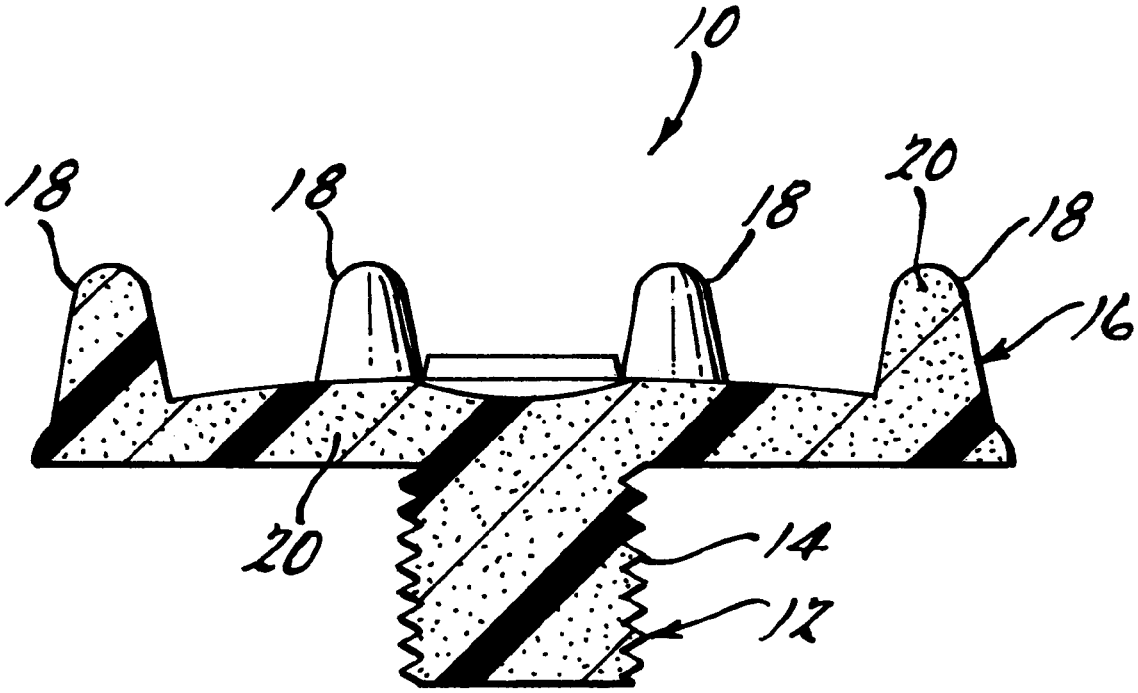
FIG. 1 is a sectional of a "soft" spike in accordance with the present invention.

In accordance with the present invention, there is provided a spike 10 for a golf shoe. The golf spike 10 includes a base portion 12 which is adapted for attachment to a golf shoe. The base portion 12 includes a shaft portion including threaded ends 14, as is typically used for attachment of golf spikes to golf shoes. The spike 10 also includes a turf-gripping spike portion 16. Portion 16 includes at least one and preferably a plurality of turf-gripping portions 18.

In accordance with the present invention, the material from which the golf spike 10 is made out of is unique. In the past, typically polymers or resilient rubbers were used to produce such spikes. In the present invention, a mixture of polymer or rubber and abrasive material 20 is utilized for the material of the golf spike 10. Typically, the spikes of the present invention will include from about 90% to 10% by weight polymer or rubber material, and 10% to 90% by weight abrasive material. Typically from about 20 to 85% polymer or rubbert material is used with about 15% to about 80% polymer material. Preferably, from about 35% to about 85% by weight polymer is used with about 15% to about 65% abrasive material. Typically, the abrasive material will be from about 40 to about 8,000 in grit size, with preferred ranges being from about 200 to about 230 grit, for abrasive particles used in the invention. Abrasive particles useful in the invention include diamond particles, tungsten carbides, aluminum oxides, silicon carbides, garnets or corundum.

In a preferred embodiment primary abrasive grits such as diamond particles may be used with secondary abrasive particles as fillers. This may be advantageous to provide a long wearing spike at reduced cost. Secondary fillers include silicon carbides, aluminum oxides, corundums and mixtures thereof. A typical composition includes (by weight) about 1% 20% diamond grit; about 5% to about 80% secondary fillers and about 5% to about 90% polymers. Suitable polymers include polypropylene, polyethylene, nylons, polycarbonates and mixtures thereof.

Preferably, the golf spike 10 is injection molded with the abrasive and polymer homogeneously intermixed. As will be readily appreciated, the shaft portion can be made of any material, as it is only critical for the wear surfaces to include the reinforcing abrasive grit. Thus, the compositions of the present invention may also be used as a material for the soles of so-called spikeless shoes for increasing the wear of the grip surfaces of such shoes. As shown in FIG. 2, portion 16 is shown integrally formed with shoe 30. As such, the traction member is a portion of the shoe 30 extending from the sole 32 of a shoe 30 for providing traction on a turf surface 34. Preferably, the materials used are injection moldable thermoplastic or thermosettable materials. For such spikeless shoes, the abrasive grit may be interspersed throughout the sole or only on the grip surfaces, as desired in the particular application.

What is claimed is:

1. A golf shoe including a traction surface for providing traction on turf; said traction surface comprising:

at least one traction member being made of a mixture of polymer material and an abrasive grit material, said abrasive grit material being a member of the set consisting of diamond particles, tungsten carbides, aluminum oxides, silicon carbides, garnets and corundum, whereby improved resistance of the traction member to wear and abrasion is provided, wherein said traction member is made of a primary abrasive grit material and a secondary abrasive grit material embodied in a polymer.

2. The golf shoe as claimed in claim 1, wherein said primary abrasive grit is a member of the set consisting of silicon carbides, aluminum oxides and corundum's.

3. The golf shoe of claim 2, wherein said primary abrasive grit is diamond.

* * * * *